United States Patent [19]

Farrington et al.

[11] Patent Number: 4,904,439

[45] Date of Patent: Feb. 27, 1990

[54] METHOD OF MAKING A NON-WOVEN FIBER WEB USING A MULTI-HEADED DUCTLESS WEBBER

[75] Inventors: Allan P. Farrington, Englishtown; Gerald M. Marshall, Somerville, both of N.J.

[73] Assignee: Johnson & Johnson, New Brunswick, N.J.

[21] Appl. No.: 220,293

[22] Filed: Jul. 18, 1988

[51] Int. Cl.[4] ..... D04H 1/72

[52] U.S. Cl. ..... 264/510; 264/113; 264/115; 264/116; 264/518

[58] Field of Search ..... 264/517, 518, 510, 511, 264/113, 112, 115, 116; 425/80.1, 81.1, 82.1, 83.1

[56] References Cited

U.S. PATENT DOCUMENTS

| | | | |
|---|---|---|---|
| 3,268,954 | 8/1966 | Joa | 264/518 |
| 3,512,218 | 5/1970 | Langdon | 425/82.1 |
| 3,535,187 | 10/1970 | Wood | 425/82.1 |
| 3,740,797 | 6/1973 | Farrington | 425/82.1 |
| 3,755,856 | 9/1973 | Banks | 264/116 |
| 3,768,118 | 10/1973 | Ruffo et al. | 264/518 |
| 3,772,739 | 11/1973 | Lovgren | 425/82.1 |
| 4,005,957 | 2/1977 | Savich | 264/518 |
| 4,724,114 | 2/1988 | MacFarland et al. | 264/510 |
| 4,767,586 | 8/1988 | Radwanski et al. | 264/113 |

FOREIGN PATENT DOCUMENTS

| | | | |
|---|---|---|---|
| 59-130353 | 7/1984 | Japan | 264/116 |

*Primary Examiner*—Jan H. Silbaugh
*Assistant Examiner*—Mary Lynn Fertig
*Attorney, Agent, or Firm*—Joseph F. Shirtz

[57] ABSTRACT

A lickerin and feed mechanism create a supply of individual fibers which follow the rotation of the lickerin. These fibers are deflected from the lickerin in the form of a stream by means of a plate arranged parallel to the lickerin. A conveying screen intercepts the stream of fibers and accumulates them into a web without the use of a high velocity stream of air to doff the fibers from the lickerin or to capture fibers on the conveyor. Further, the housing for the apparatus is opened so that there are no seals to compress the web after it is produced. Multiple lickerins and feed mechanisms may be spaced along the conveying screen to create multiple-layer or blended products. The feed mechanisms may include devices for spraying particulate material on previously formed layers or blending it with fibers as a layer is formed.

13 Claims, 6 Drawing Sheets

METHOD OF MAKING A NON-WOVEN FIBER WEB USING A MULTI-HEADED DUCTLESS WEBBER

This is a division of application Ser. No. 075,702, filed July 20, 1987, now U.S. Pat. No. 4,795,335.

TECHNICAL FIELD

The present invention relates to methods and apparatus for forming non-woven structures of fibers and, more particularly, to the efficient formation of uniform or blended, multi-layer, fiber structures.

BACKGROUND ART

Non-woven fabrics are structures consisting of accumulations of fibers typically in the form of a web. Such fabrics have found great use in disposable items, such as hand towels, table napkins, curtains, hospital caps, draperies, etc., because they are far less expensive to make than conventional textile fabrics made by weaving and knitting processes.

There exist many different processes for forming non-woven structures. The processes, however, when used to generate fiber structures from fibrous stock, generally involve introducing the individualized fibers into an air stream, such that the fibers are conveyed at high velocity and high dilution rates to a condensing screen. The individualized fibers may be generated by using a lickerin or wire-wound roll to grind or shred fibrous material. There are also other techniques for generating individual fibers, e.g. through the use of various mills. The air stream is tangentially passed over the fiber-laden lickerin, or about the mill, to doff or remove the fibers and entrain them in the air stream. Typically the air stream with the fibers is contained within a duct from the point of grinding to the point of deposition upon the condenser screen. In order to maintain the air stream in the duct at velocities high enough to ensure a uniform flow and deposition of the fibers upon the condensing screen, as well as to assure that the fibers do not adhere to the duct walls, it is necessary to employ a fan or other suction device beneath the condensing screen to create a pressure of at least 20 inches of water, and often up to 100 inches of water.

U.S. Pat. No. 3,512,218 of Langdon discloses apparatus for forming non-woven webs with two lickerins. The fibers are doffed from the lickerins by a single air stream formed by a suction box below the condensing screen. U.S. Pat. No. 3,535,187 of Wood discloses a similar arrangement wherein two air streams are used to doff the fibers from the lickerin. According to U.S. Pat. No. 3,772,739 of Lovgren both pulp fibers and longer textile fibers are individualized and blended in apparatus using high speed lickerins rotating at different speeds. As in the other references, the individualized fibers are doffed from their respective lickerins by separate air streams produced by a suction fan located in the condenser section of the apparatus. A baffle plate inserted between two lickerins for controlling the degree of mixing of fibers doffed by air streams passing over separate lickerins is described in U.S. Pat. Nos. 3,768,118 of Ruffo et al. and 3,740,797 of Farrington.

In these references, and generally in the prior art, the high speed air streams impel the fibers against the condenser screen at such a speed that there is a compression of the resulting web. In addition, the particles, after leaving the lickerin, are conducted to the condensing screen by a duct structure which confines their travel and, due to the air pressure, accelerates their travel. In order to assure that the air pressure is not reduced, seal means are provided where the duct structure engages the moving condenser screen. This may be in the form of floating or rolling seals, which further act to compress the fiber web as it is withdrawn from the condenser on the moving screen.

Because of the substantial pressure which must be generated in order to create the high speed air streams, the prior art methods of producing webs require a great deal of energy. In addition, the resulting web is compressed both by the air stream and the seals that are used to maintain the pressure for the air stream. Thus, it would clearly be advantageous to the production of fluff fiber structures if they could be created with much less energy and with less compression, i.e., much greater loft.

DISCLOSURE OF THE INVENTION

The present invention is directed to a method and apparatus for (1) forming high loft, multi-layer fiber structures without the use of high speed air streams and ducts, such that much less energy is needed and a more lofty web is formed, and (2) blending other short fibers or particulate matter into the fiber structure.

In an illustrative embodiment of the invention a frame structure is used which has an endless conveyor screen in its lower section. This screen enters the frame structure at one end and exists at the other. At the locations where the conveyor screen enters and leaves the frame, the frame is open to the atmosphere.

At an upper portion of the frame there are at least two feeding means for feeding fibrous material into engagement with at least two high speed rotating lickerins that are spaced from each other in the direction of travel of the conveyor screen and have axes generally perpendicular to the travel of the conveyor screen. Each feeding means essentially comprises a feed roller, which forces the fibrous material against the lickerin, and a nose bar that holds the material in place as its end is shredded by the wire projections of the lickerin.

It has been found that in the absence of a high speed air stream, the individualized fibers created by the lickerin tend to follow the peripheral direction of the lickerin. However, if a deflector plate is positioned parallel to the axis of the lickerin, but closely spaced from its peripheral surface, the fibers are directed from the lickerin in a stream towards the conveyor screen located in the lower portion of the frame.

At the conveyor screen the individual particles are accumulated into a non-woven fiber structure. As the screen is moved a continuous fiber structure is formed, which structure extends out of the open end of the frame to other processing equipment.

The lickerin located toward the entrance end of the apparatus, lays down the bottom layer of the web and the lickerin towards the exit end lays down the upper layer. At the interface between the two layers, the fibers are intermingled so that an integral web is formed.

It is also possible to rotate the lickerins in opposite directions and to position the deflector plates so that the streams of fibers from the two lickerins intersect at the conveyor so that the web is formed as a composite of the fibers fed to both lickerins.

If desired, a relatively low air pressure may be created in a suction chamber below the screen. This acts to keep dust particles at a minimum and to improve the lateral placement of the fibers in forming the web. However, this low pressure is insufficient to doff the individual fibers from the lickerin. In particular, the suction pressures can be less than 5 inches of water, and are preferably in the range of ½ to 1 inch of water, as opposed to 20 to 100 inches of water as in prior art processes.

Webs formed by this new process are typically more lofty than webs formed using a conventional process because of the lower compression effect resulting from the elimination of the high velocity depositing stream and the absence of seals positioned at the exit of the conveyor screen from the frame.

Other materials can be blended with the fibrous streams deflected from one or more of the lickerins. This is accomplished by mounting a feed tray beneath and parallel to the nose bar of the lickerin. The rotation of the lickerin creates a high velocity airstream in proximity to the rotating surface. This airstream draws particulate or fibrous materials in the tray toward the lickerin, where they are blended with the fiber stream. This results in the creation of unique blended non-woven fiber products.

When two materials of different densities are combined through the use of a feed tray, it is also possible to control the relative positioning of the two components in the resulting fiber structure by varying the shape of the discharge edge of the deflector plate. A sharp-edged, straight plate will yield a uniformly blended web. However, a discharge edge that is angled or curved away from the normal direction of flow, will create a wall attachment effect that causes light weight particles to follow the contour of the wall, while heavy particles, under inertial influence, continue in a straight line. The result is a preponderance of heavy particles in the lower layers and light particles in the upper layers of the fiber structure.

BRIEF DESCRIPTION OF THE DRAWINGS

The foregoing and other features of the present invention will be more readily apparent from the following detailed description and drawings of illustrative embodiments of the invention in which.

DESCRIPTION OF AN ILLUSTRATIVE EMBODIMENT

Figure 1:
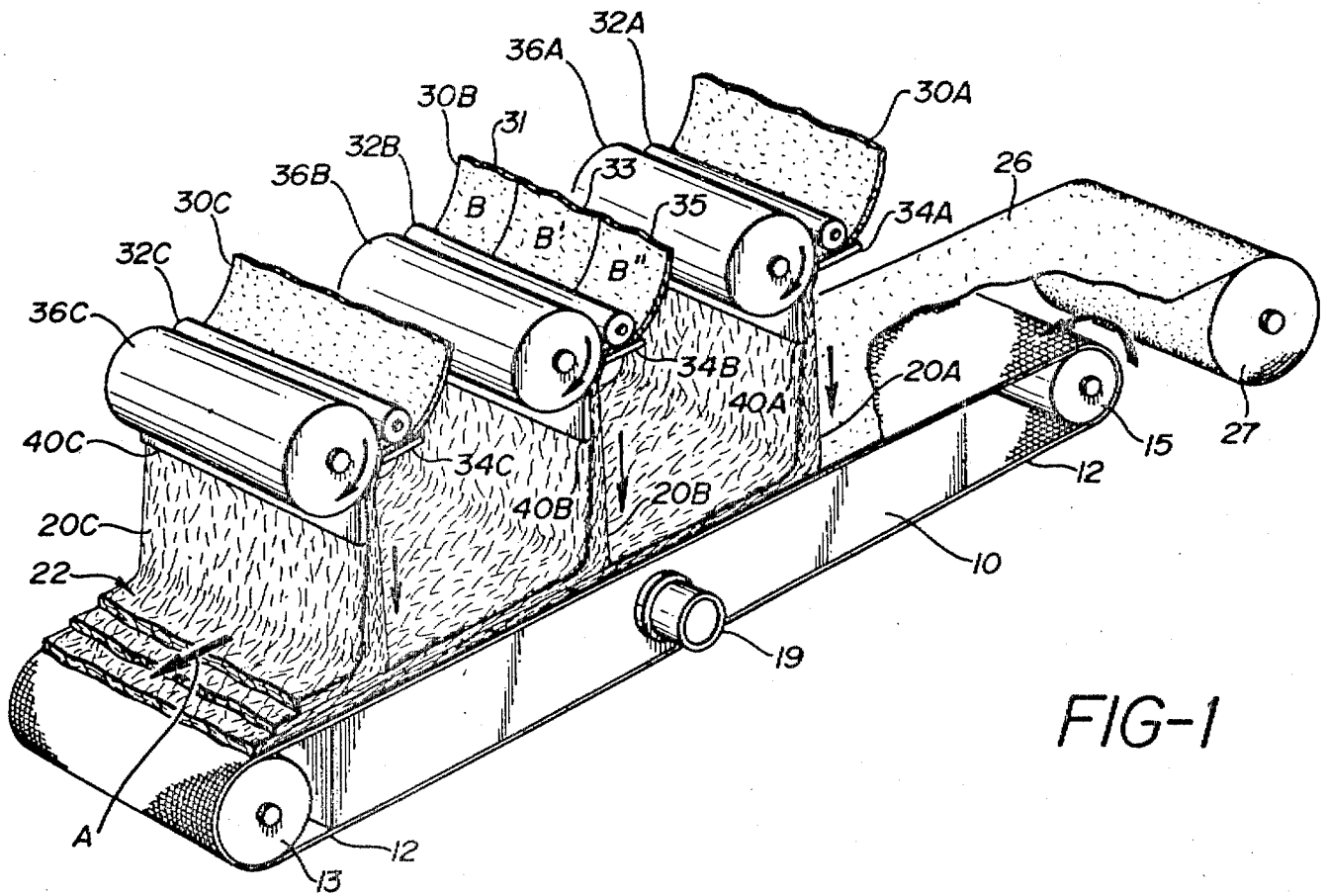
FIG. 1 is a schematic illustration of apparatus for carrying out the present invention, but with the frame removed.

In FIG. 1 there is shown the lower portion of a frame structure for carrying out the present invention. This structure includes a low vacuum chamber 10 which creates vacuum forces on a conveyor mesh screen 12. This screen is moved by a motor (not shown) such that it travels from the right of FIG. 1 to the left, as shown by arrow A. Because the screen 12 is continuous, it passes about a roller 13, under the vacuum chamber 10, over a roller 15 and back into the frame of the apparatus over the top of vacuum chamber 10. The perforations in conveyor screen 12 allow a suction force which is less than 5 inches of water, and preferably in the range of ½ to 1 inch of water, to be created across the screen where the screen is over openings in the vacuum chamber 10. This low vacuum is created in chamber 10 by suction in a conduit 19, shown extending from a side of the housing.

One of the desirable features of this device is that it allows the nonwoven structure 22 to be formed on a porous substrate 26. This substrate 26 may be tissue paper or a similar porous thin web material. It may be fed from a roll 27 and carried into the frame by screen 12. Such a substrate will generally have a uniform width that is the same or greater than that of the formed web 22. However, in FIG. 1, the substrate 26 is shown partially broken away to reveal the screen 12.

Figure 4:
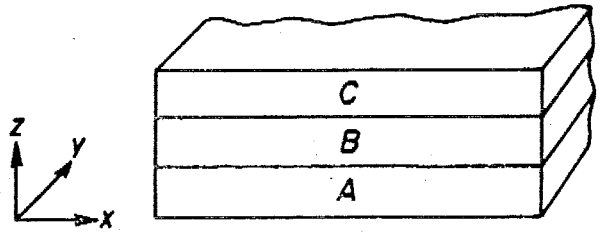
FIGS. 4–6 are cross sections of various products made according to the embodiments of FIGS. 2 and 3.

The conveyor screen 12 with substrate 26 on top intersects streams 20A, 20B and 20C of individualized fibers from the lickerins 36A, 36B, 36C. The screen and substrate act to accumulate the fiber streams to form the composite web 22 of fiber material. Thus web 22, as shown in FIG. 4, has a bottom layer A, e.g. of textile or long fibers, such as those with good wicking characteristics, which are received from lickerin 36A. The middle layer B is made up, for example, of pulp fibers from lickerin 36B that have good absorbent properties. The top layer C may be made from long fibers that are hydrophobic in nature and are received from lickerin 36C. At their interface the fibers are intermingled to form an integral multi-layered web.

The raw material for generating the fibers is typically derived from various fibrous stock 30 such as pulp board 30B and textile fiber carded batts 30A and 30C. Pulp boards come in varying thicknesses and lengths and are a ready source of "short fibers" The term "short fibers" typically refers to paper making fibers, such as wood pulp fibers or cotton linters, having a length less than about ¼ inch. These fibers are inexpensive and absorbent, and thus are greatly used. In addition to pulp boards, these fibers may be obtained from various types of wood, asbestos, glass fibers and the like.

The textile carded batts are a ready source of long fibers that are generally between ½ and 2½ inches in length. These fibers are typically synthetic fibers, such as cellulose acetate fibers, vinyl chloride-vinyl acetate fibers, viscose staple rayon, and natural fibers, such as cotton, wool or silk.

The fibrous materials are directed to the lickerins by means of separate feed rollers 32A, 32B, 32C and nose bars 34A, 34B, 34C. In particular, the feed rollers 32 are rotated by motors (not shown) to drive the fibrous material 30 against the wire projections of the individual lickerins 36. The materials 30 are engaged by the feed rolls and nose bars 34 in a conventional manner such that the projections of the lickerins can open or separate the fibers from the sources.

The speeds of the feed rollers 32 control the rate at which the fiber materials are fed against the lickerins, and thus affects the thickness of the web which is formed at any particular speed for the conveyor screen 12. The spacing of the respective nose bars from the feed rollers and the lickerins are optimized for the particular fibrous material 30 being utilized, such that it can be assured that complete separation of the fibers is accomplished. In addition the speeds of the lickerins are set to optimize the fiberization process. For example if the lickerins 36A, 36C are about 9" in diameter, they may be rotated at about 2,000 r.p.m., which is optimum for long textile fabrics; while a 9" lickerin 36B, may be rotated at 4,000 to 6,000 r.p.m., which is optimum for short pulp fibers.

As the fibers are separated from materials 30 they unexpectedly become entrained in air streams created by the high speed rotation of lickerins 36. As a result, the fibers tend to follow the contour of the periphery of each lickerin. In order to doff these fibers from the lickerins, defector plates 40A, 40B, 40C are positioned at particular locations along the peripheral direction of rotation of the lickerins 36. The effect of these deflector plates is to separate the streams of individual fibers from the lickerins and to direct them onto the substrate 26 and conveyor screen 12. The deflector plates are not in contact with the lickerins. However, it is believed that they act to separate the fibers from the lickerins by deflecting the air streams created by the lickerin rotation towards the conveyor screen, so that the fibers, which are entrained in these air streams, follow the air streams onto the conveyor screen.

Figure 2:
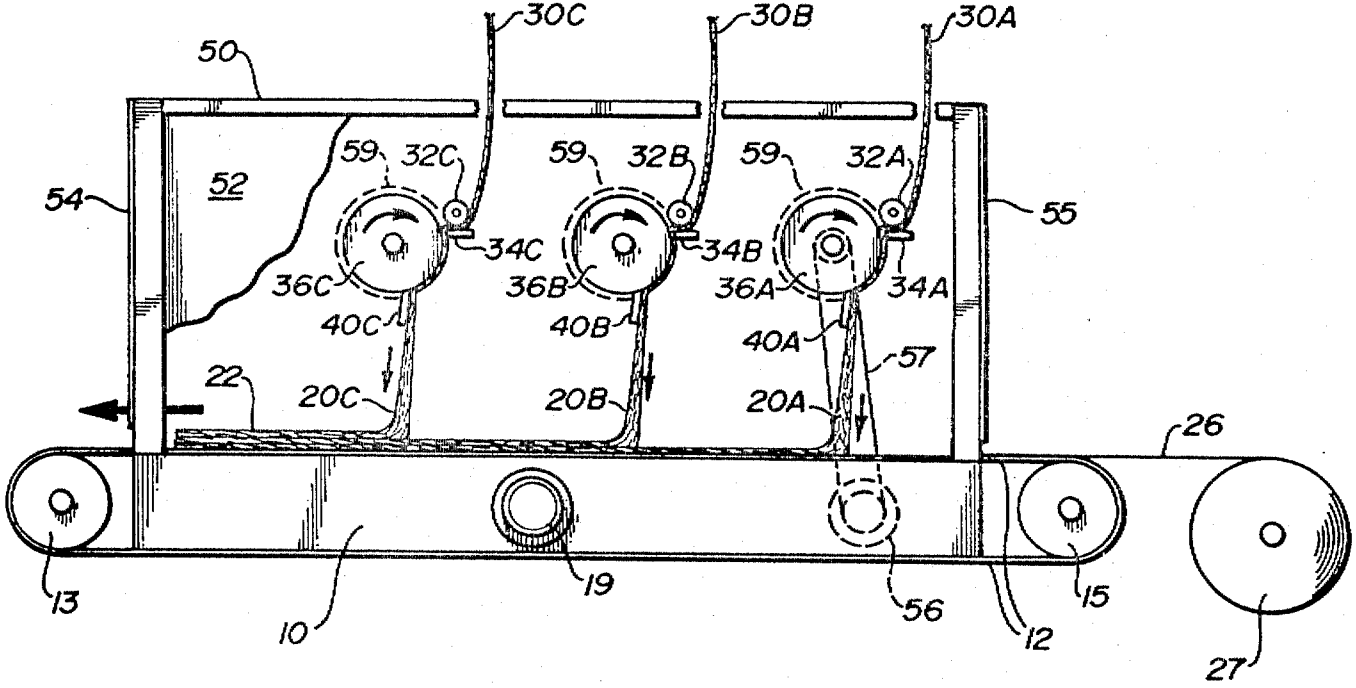
FIG. 2 is a schematic illustration of a side view, partially broken away, of apparatus for practicing the present invention, including the frame thereof.

In FIG. 2, a frame 50 for the apparatus is illustrated. The frame has no top, but it has side plates 52 which are shown broken away so that the interior of the structure can be seen. These side plates 52 act to support feed rolls 32, nose bars 34 and lickerins 36.

The end plates 54 and 55 at the exit and entrance to the apparatus, respectively, stop at some distance above the conveyor screen 12. Thus, the interior of the frame is open to the atmosphere and cannot be under a high vacuum. Further, the end walls 54, 55 do not contain any sealing rollers or floating seals to maintain a vacuum. The absence of such a seal at end plate 54, assures that the natural loft of the web created by the present invention is not compressed.

As shown in FIG. 2, a motor 56 is connected to a belt 57 and acts to turn the lickerin 36A at the proper speed for optimum individualization of the fibers. Similar arrangements (not shown) drive the other lickerins.

A device according to the present invention is capable of forming uniform low density webs at speeds in excess of 300 linear feet per minute. At a speed of 300 feet per minute, webs of weights up to 2 ounces per square yard per lickerin can be achieved. At slower speeds, the apparatus can produce webs in excess of 20 ounces per square yard.

In a preferred embodiment, a cover 59 extends from the deflector plate 40 to the feed roll 32 on the side of each lickerin away from the fiber streams 20. This additionally acts to prevent the air streams from completely circling the lickerins and carrying individual fibers beyond the deflector plate 40.

Figure 5:
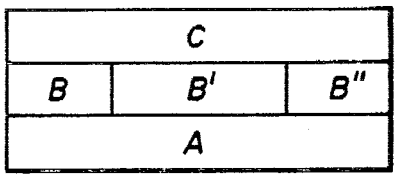

While typically a single fiber material 30 would be fed to each lickerin, it is also possible to feed simultaneously separate materials, e.g. pulp boards 31 (fiber B), 33 (fiber $B^1$) and 35 (fiber $B^{11}$) to the same lickerin as shown in FIG. 1. Further, it is possible to form unitary boards having three different segments. These segments B, $B^1$, $B^{11}$ may be distinguished by a difference in composition or merely a difference in color. When such an arrangement is used, the cross-sectional shape of the web produced is as shown in FIG. 5. In particular, there will be three separate lateral zones forming the web material, at least in the middle layer, if separate pulp boards are fed to lickerin 36B.

Figure 3:
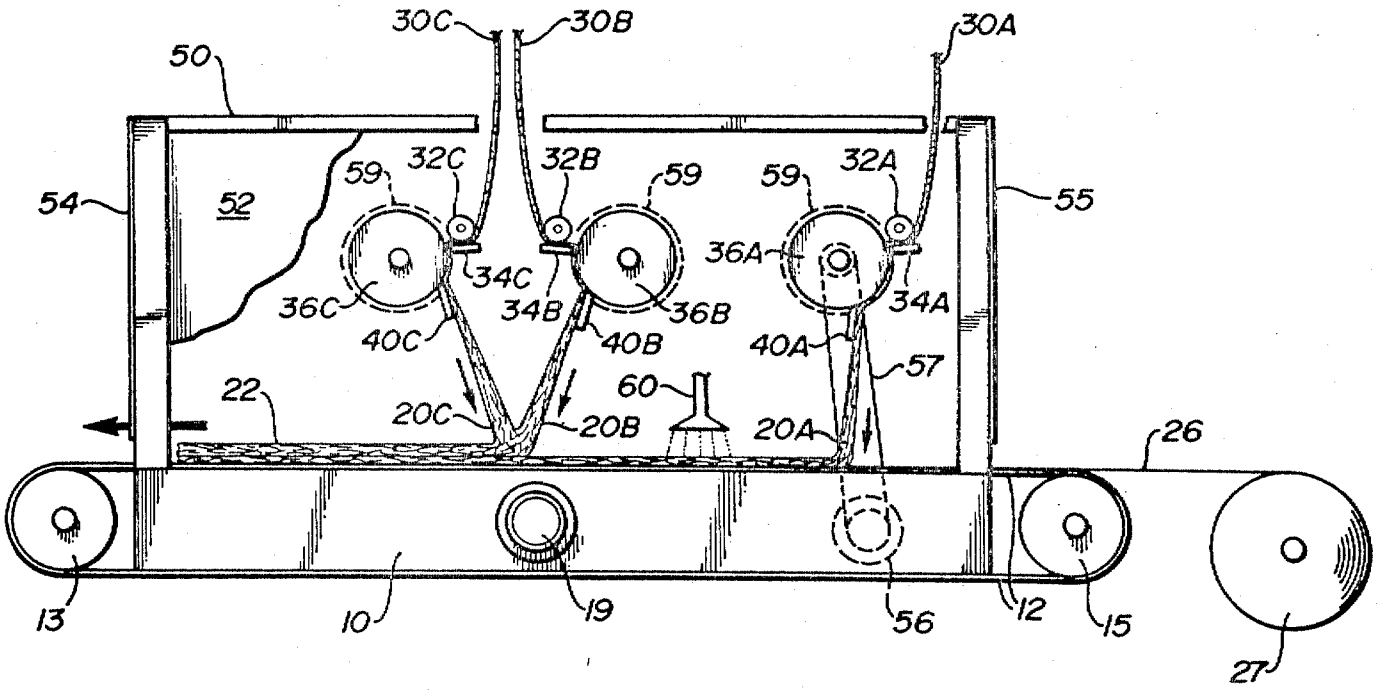
FIG. 3 is a schematic illustration of apparatus for practicing the present invention in which two fiber streams are blended at the conveyor screen.
Figure 6:
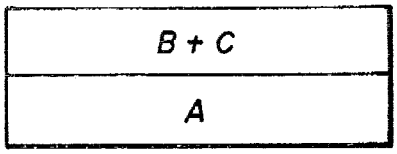

A blending of different fibers can be achieved as the web is formed by directing two or more of the fiber streams 20 at the same position on the screen 12. In FIG. 3 this blending is shown by the intersection at the screen of fiber streams 20B and 20C. Stream 20C can be formed by reversing the direction of rotation of lickerin 36C and reversing the position of the feed mechanism made up of feed roller 32C and nose bar 34C, as well as deflector 40C. Since the fibers tend to cling to the lickerin, it is also possible to rotate lickerin 36C in its conventional direction, but to move deflector 40C to a point that will still cause the fiber stream 20C from lickerin 36C to impact at the same location on screen 12 as the fiber stream 20B. The product created by the arrangement of FIG. 3 is shown in FIG. 6 where the bottom layer is of fibers A from lickerin 36A and the top layer is a blend of fibers B and C from lickerins 36B and 36C.

A nozzle 60 (FIG. 3) may be optionally provided above the screen 12. This nozzle may be used to spray useful granules, powders or liquids, e.g. super absorbent material, onto the web such that it becomes embedded within the web. This nozzle may be turned on and off to create discrete pockets of this material along the web. The web may later be separated between these pockets to form products. If the nozzle applies a super absorbent monomer liquid to the web, it may be necessary to subsequently polymerize and cross-link the liquid by irradiation or other means.

In order to create various products, the width and thickness of the fibrous materials fed to the lickerins can be varied.

Products produced by the present invention have more loft than conventional products. It is believed that this results because a greater proportion of the individual fibers are deposited in the present invention such that their axes are generally perpendicular to the conveyor screen, than in prior high vacuum type systems. This results in more resiliency in the web perpendicular to the screen (i.e. in the Z direction in FIG. 4) and a product that has better fluid uptake. When a strong suction force is used below the screen, the fibers tend to flatten out, which removes the resiliency perpendicular to the screen and the natural channels for conducting fluids across the thickness of the web.

In conventional dual rotor machines, such as that described in U.S. Pat. No. 3,740,797 of Farrington, there is a loss of between 8 and 12 pounds of fiber per hour, due to the high suction, when using a 40 inch long lickerin. With the present invention, however, there is only about ⅓ of a pound per hour lost. Thus, there is less material which is wasted and less clean up is required in the vicinity of the machine.

In a ductless device according to the present invention, the stream of material has a greater fiber to air ratio than in a machine like that of the Farrington patent. However, fibers are deposited at a slower velocity. These two effects tend to cancel each other so that the ductless weber has the same throughput as a conventional weber. Also, in the conventional webber there tends to be an overlapping of fibers, which creates a shingle effect in the machine or conveyor belt direction. This may cause the web to separate. However, this shingle effect is absent from products produced according to the present invention.

It may be desirable to blend other materials in the non-woven structure created by the apparatus of the present invention. This can be accomplished by installing an open feed tray 62 beneath the nose bar 34 as shown in FIG. 7.

Individualized short fibers, e.g. from a hammer mill, or other fine particulate materials, e.g. superabsorbent powders, are placed or metered into the tray. The high velocity air stream created in proximity to the lickerin surface due to its rotation, draws the fine particulate material (e.g. either fibers or granules) in the tray toward the lickerin. The material is drawn to the lickerin because the high speed rotation of the lickerin creates a low static pressure zone at its periphery.

At the lickerin the particles from the feed tray blend with the fibers following the lickerin and create a generally uniform blend of fibers and particles. This blend is deflected from the lickerin as a blended fiber stream by the deflector plate 40. The result is a blended product such as that shown in FIG. 9A.

Figure 7:
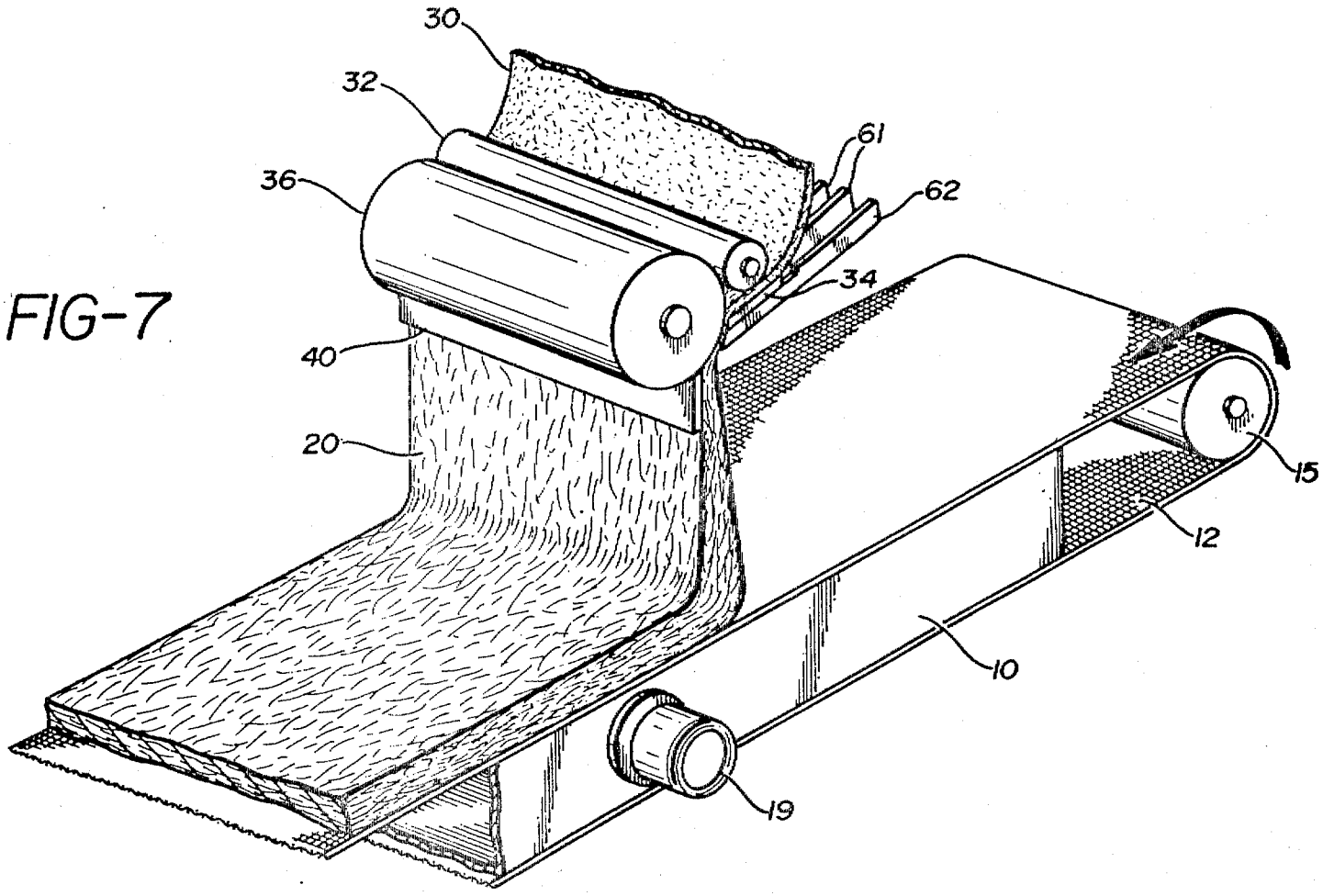
FIG. 7 is a side sectional view of the apparatus of FIG. 2 equipped with a feed tray.

As shown in FIG. 7, the tray may have longitudinal dividers 61 within it. Different particulate material may be located in each section of the tray formed by the dividers. These different materials will tend to be drawn to the portion of the lickerin immediately in front of the portion of the tray where they are located, and then deflected to the corresponding portion of the forming web. If materials A, B, and C are spaced evenly in the tray, this material will be blended in the web product as shown by the middle layer of the product of FIG. 5. In this case the lickerin shown in FIG. 7 would be lickerin 36B of FIG. 2. The difference from the prior description of FIG. 5, however, is that the pulp fibers will be uniform and the variation in material will be in the concentration of particles mixed with the fibers.

Figure 8:
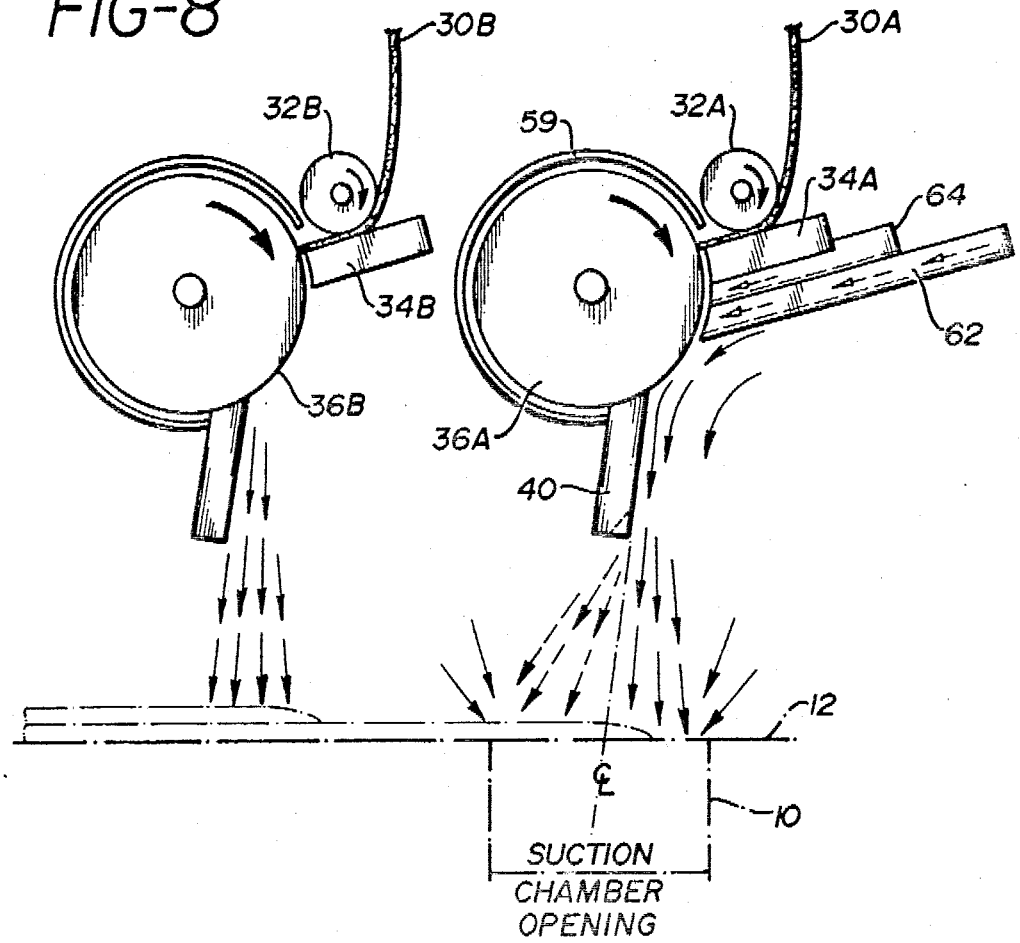
FIG. 8 is a schematic side view of the apparatus of FIG. 7 showing two feed trays and the effect of angling the deflector plate.

Instead of a single feed tray, one or more additional trays may also be used. As shown in FIG. 8, a second tray 64 is located above the first tray 62 and supplies an additional source of particulate matter to the fiber stream. As with tray 62, tray 64 may have a number of dividers with different types of particulate materials in each section of the tray. These materials in tray 64 will not only blend with the short fibers, but will also blend with the particulate matter in tray 62 which is adjacent the same section of the lickerin. As a result, strips of uniquely blended combinations of two or more particles and short fibers can be formed along the continuously forming fiber structure.

Figure 9A:
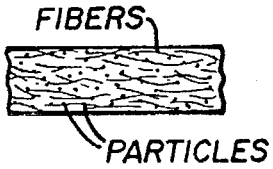
FIGS. 9A and 9B are cross-section views of products made by the apparatus of FIG. 8.
Figure 9B:
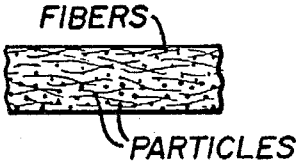

Generally the deflector plate 40 is straight and the fiber stream is directed straight down on to the conveyor as shown by the solid arrows in FIG. 8. This results in a uniform blend of fibers and particles as shown in FIG. 9A. However, if the edge of the deflector adjacent the fiber stream is angled (as shown in dotted line) or given a radius curve, light particles, e.g. pulp fibers, will follow the curve or angle of the deflector plate due to the wall attachment or Coanda effect. Thus these fibers are deposited at a different angle as shown by the dashed arrows in FIG. 8. The heavy particles, e.g. thermoplastic bonding particles, will continue in the straight line under the influence of inertia. The angled deflector plate results in the heavy particles being laid down mainly toward the bottom of the layer of the web produced by the related lickerin and the light particles toward the top layer of web as shown in FIG. 9B.

In one example of the present invention, individual pulp fibers can be generated by the lickerin by engagement with pulp fiber board. Superabsorbent powder can be drawn to the lickerin from the first feed tray and thermoplastic bonding particles (e.g. polyethylene granules) from the second tray. Depending on the type of deflector, these particles can be uniformly blended or laid down in sub-layers predominated by one of these materials. Subsequently, other layers can be added to the web from succeeding lickerins. Then the web can be heated so the fiber and superabsorbent particles in the first layer are stabilized by the thermo-bonding material and retain their position in the structure.

While the invention has been particularly shown and described with reference to a preferred embodiment thereof, it will be understood by those skilled in the art, that various changes in form and details may be made therein without departing from the spirit and scope of the invention.

What is claimed is:

1. A method of forming a non-woven fiber web comprising the steps of:

feeding at least one source of fibrous material into engagement with at least one lickerin;

rotating the at least one lickerin at such a speed that the material is opened so as to form individual fibers moving with the lickerin;

deflecting the individual fibers from the lickerin in the the form of a stream of fibers by positioning one end of a deflector plate parallel to the lickerin, adjacent to the peripheral surface of the lickerin and another remote end away from the lickerin, so a guiding surface of the deflector plate guides the fibers from the lickerin;

keeping the lickerin free of air streams which would tend to doff the fibers from the lickerin;

keeping the stream of fibers free of confining ducts; and intercepting the stream of fibers with a moving conveyor and accumulating the fibers on the conveyor to form a web of material.

2. A method as claimed in claim 1, wherein the step of feeding involves simultaneously feeding at least two different laterally-spaced fiber materials to said lickerin.

3. The method as claimed in of claim 1, further including the step of protecting the peripheral surface of the lickerin with a cover extending from the deflector plate to the feed means on the side of the lickerin opposite the fiber stream.

4. The method as claimed in claim 3, further including the step of creating a vacuum of less 5 inches of water through perforations in the conveyor.

5. The method as claimed in claim 1 in which the step of intercepting includes the step of moving a conveyor below the lickerin such that the stream of fibers is intercepted by the conveyor.

6. The method as claimed in claim 5 wherein the steps of feeding, rotating and deflecting involve at least feeding first and second rotating lickerins spaced from each other in the direction of travel of the conveyor and deflecting fibers from the lickerins such that the web is formed with fibers from both lickerins.

7. The method as claimed in claim 6 further including the step of providing a porous substrate on the moving conveyor prior to intercepting the streams of fibers with the conveyor, such that the web of material is formed on the substrate.

8. The method as claimed in claim 6 wherein said at least first and second lickerins are sequentially spaced along the direction of travel of the conveyor, and the step of deflecting involves deflecting the fiber streams such that the web is formed with a first layer of fibers from the first lickerin and a second layer of fibers from the second lickerin.

9. The method as claimed as claim 8 further including the step of spraying material onto the first layer.

10. The method as claimed in claim 9 wherein the material sprayed is super absorbent material.

11. A method of forming a non-woven fiber web on a moving conveyor comprising the steps of:

feeding at least one source of fibrous material into engagement with a first and second rotating lickerins spaced from each other in the direction of travel of the conveyor;

rotating the lickerins at such a speed that the material fed to the respective lickerins is opened so as to form individual fibers moving with the respective lickerin;

deflecting the individual fibers from the respective lickerin in the form of a stream of fibers by positioning one end of a deflector plate adjacent to the peripheral surface of each lickerin and another remote end of each plate away from the respective lickerin, so a guiding surface of the deflector plate guides the fibers from the lickerin;

keeping the lickerin free of air streams which would tend to doff the fibers from the lickerin;

keeping the streams of fibers free of confining ducts;

locating at least one open tray of particulate material adjacent at least one lickerin so that the material is drawn to the lickerin due to the rotation of the lickerin and is blended with the fibers for deflection by the deflector plate; and intercepting the fibers from each lickerin by moving a conveyor beneath the fiber streams and accumulated the fibers on the conveyor to form a web of material.

12. The method as claimed in claim 11 further including the step of providing a taper to the deflector plate away from the guiding surface at the remote end of the plate, such that the fibers and the particulate material are deflected at different angles.

13. A method of forming a non-woven fiber web on a moving conveyor comprising the steps of:

feeding a source of fibrous material into engagement with a first and a second lickerin spaced from each other in the direction of travel of the conveyor;

rotating the lickerins at such a speed that the respective material is opened so as to form individual fibers moving with the lickerin;

deflecting the individual fibers from the lickerins in the form of a respective stream of fibers by positioning one end of a deflector plate adjacent to the peripheral surface of each lickerin and another remote end away from the respective lickerin, so a guiding surface of the deflector plate guides the fibers from the lickerins such that the fiber streams from the first and second lickerin are intercepted by the conveyor in the same area on the conveyor and the web formed is a blend of fibers from both lickerins;

keeping the lickerins free from air streams which would tend to doff the fibers from the lickerins;

keeping the stream of fibers free of confining ducts; and intercepting the streams of fibers with said conveyor by moving said conveyor and accumulating the fibers on the conveyor to form a web of material.

* * * * *

UNITED STATES PATENT AND TRADEMARK OFFICE

CERTIFICATE OF CORRECTION

PATENT NO. : 4,904,439

DATED : February 27, 1990

INVENTOR(S) : Allan P. Farrington and Gerald M. Marshall

It is certified that error appears in the above-identified patent and that said Letters Patent is hereby corrected as shown below:

In Column 9, line 35 and Column 10, line 1 (Claim 11):

"accumulated" should be --accumulating--.

Signed and Sealed this

Fourteenth Day of May, 1991

*Attest:*

*Attesting Officer*

HARRY F. MANBECK, JR.

*Commissioner of Patents and Trademarks*